US008977185B2

(12) United States Patent
Sato et al.

(10) Patent No.: US 8,977,185 B2
(45) **Date of Patent: *Mar. 10, 2015**

(54) CONFIGURATION FOR AN IMAGE FORMING APPARATUS HAVING AN UPRIGHT RECORDING MEDIUM STORAGE UNIT

(75) Inventors: Shougo Sato, Seto (JP); Shigeharu Katayama, Kakamigahara (JP); Mitsuko Hanai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 866 days.

This patent is subject to a terminal disclaimer.

(21) Appl. No.: 12/057,102

(22) Filed: Mar. 27, 2008

(65) Prior Publication Data

US 2008/0240817 A1 Oct. 2, 2008

(30) Foreign Application Priority Data

Mar. 30, 2007 (JP) ..... 2007-092115

(51) Int. Cl.
*G03G 15/14* (2006.01)
*G03G 15/08* (2006.01)
(Continued)

(52) U.S. Cl.
CPC ..... *G03G 15/6502* (2013.01); *G03G 15/6552* (2013.01); *G03G 2215/00004* (2013.01); *G03G 21/1685* (2013.01); *G03G 2215/00383* (2013.01); *G03G 21/1609* (2013.01)
USPC ..... 399/393; 399/388; 399/25; 399/255

(58) Field of Classification Search
USPC ..... 399/120, 405, 33, 400, 692, 113, 393, 399/388, 25, 297, 255, 256, 258; 400/691–693
See application file for complete search history.

(56) References Cited

U.S. PATENT DOCUMENTS 4,727,387 A * 2/1988 Israely ..... 347/139
5,065,197 A * 11/1991 Mitsuyama ..... 399/381
(Continued)

FOREIGN PATENT DOCUMENTS

JP 2079876 A 3/1990
JP 4333063 A 11/1992
(Continued)

OTHER PUBLICATIONS

Office action in corresponding U.S. Appl. No. 12/057,088 mailed Nov. 22, 2010.
(Continued)

*Primary Examiner* — Matthew G Marini
(74) *Attorney, Agent, or Firm* — Banner & Witcoff, Ltd.

(57) ABSTRACT

An image forming apparatus includes a recording sheet storage unit for storing recording sheets substantially in an upright position, an image forming unit which forms an image on a recording sheet conveyed from the recording sheet storage unit, and a recording sheet receiving unit for storing the recording sheet conveyed from the image forming unit substantially in an upright position. In this image forming apparatus, a paper conveyance passage extends upward from a lower portion of the recording sheet storage unit toward the recording sheet receiving unit. The image forming unit positioned on the paper conveyance passage comprises a fixing device and a developer unit at least including a developer carrier, and the fixing device is arranged above the developer unit. Further, a developer receptacle for storing developer that is supplied to the image forming unit is arranged adjacent to one longitudinal end of the developer carrier.

15 Claims, 14 Drawing Sheets

(51) Int. Cl.

| | |
|---|---|
| ***G03G 15/00*** | (2006.01) |
| ***G03G 21/16*** | (2006.01) |

(56) References Cited

U.S. PATENT DOCUMENTS

| | | | | |
|---|---|---|---|---|
| 5,653,437 | A | 8/1997 | Inoue et al. | |
| 6,945,720 | B2 * | 9/2005 | Maekawa et al. | 400/624 |
| 7,257,349 | B2 | 8/2007 | Kitozaki | |
| 7,502,577 | B2 | 3/2009 | Kitozaki et al. | |
| 7,636,528 | B2 | 12/2009 | Sato et al. | |
| 7,686,446 | B2 * | 3/2010 | King et al. | 347/108 |
| 2002/0064395 | A1 * | 5/2002 | Funayama et al. | 399/120 |
| 2005/0135841 | A1 * | 6/2005 | Murakami et al. | 399/258 |
| 2005/0175373 | A1 * | 8/2005 | Okamoto et al. | 399/119 |
| 2005/0281581 | A1 | 12/2005 | Kitozaki | |
| 2005/0281591 | A1 | 12/2005 | Kitozaki et al. | |
| 2006/0024094 | A1 * | 2/2006 | Uehara | 399/299 |
| 2006/0083564 | A1 | 4/2006 | Yazawa et al. | |
| 2006/0221170 | A1 | 10/2006 | Sato et al. | |
| 2010/0061757 | A1 | 3/2010 | Sato et al. | |

FOREIGN PATENT DOCUMENTS

| | | | |
|---|---|---|---|
| JP | 5113720 | A | 5/1993 |
| JP | 08-002769 | | 1/1996 |
| JP | 08-259076 | | 10/1996 |
| JP | 2003-302889 | | 10/2003 |
| JP | 2005199721 | A | 7/2005 |
| JP | 2006030958 | A | 2/2006 |
| JP | 2006-205541 | | 8/2006 |
| JP | 2006276775 | A | 10/2006 |

OTHER PUBLICATIONS

Decision of Patent Grant for Japanese patent application No. 2007-092115 mailed Feb. 28, 2012.

Notification of Reasons for Refusal for Japanese patent application No. 2007-092115 mailed Sep. 6, 2011.

Notification of Reasons for Refusal for Japanese patent application No. 2007-091876 mailed Sep. 6, 2011.

Notification of Reasons for Refusal for Japanese patent application No. 2007-092115 mailed Dec. 6, 2011.

Notification of Reasons for Refusal for Japanese patent application No. 2007-091876 mailed Dec. 6, 2011.

Office Action issued in corresponding U.S. Appl. No. 12/057,088 dated May 30, 2012.

Office Action in related U.S. Appl. No. 12/057,088 mailed Sep. 28, 2012.

Non Final Office Action issued in corresponding U.S. Appl. No. 12/057,0088 mailed Mar. 25, 2013.

* cited by examiner

CONFIGURATION FOR AN IMAGE FORMING APPARATUS HAVING AN UPRIGHT RECORDING MEDIUM STORAGE UNIT

CROSS REFERENCE TO RELATED APPLICATIONS

This application claims the foreign priority benefit under Title 35, United States Code, §119(a)-(d) of Japanese Patent Application No. 2007-092115 filed on Mar. 30, 2007 in the Japan Patent Office, the disclosure of which is herein incorporated by reference in its entirety.

BACKGROUND OF THE INVENTION

The present invention relates to an image forming apparatus such as a laser printer.

As an image forming apparatus such a laser printer, an upright-type image forming apparatus is generally known. For example, Japanese Laid-open Patent Application No. 2003-302889 discloses such an upright-type image forming apparatus, in which a paper feed tray (recording sheet storage unit) for storing papers as recording sheets and a paper output tray (recording sheet receiving unit) are arranged back and forth with these trays positioned upright.

In this image forming apparatus, the paper feed tray is arranged higher than the paper output tray, so that a paper conveyance passage extending from a lower part of the paper feed tray to a lower part of the paper output tray for conveying a paper is bent to form an L-shaped configuration. An image forming unit which forms an image on a paper is positioned intermediate of this paper conveyance passage at an extension extending downward from the lower part of the paper feed tray.

More specifically, the image forming unit includes a developer unit equipped with a toner cartridge and a developing roller, and a fixing device for thermally fixing developer that is transferred on a paper. The image forming unit is arranged such that the fixing device is positioned below the developer unit on the paper conveyance passage. Further, in this image forming apparatus, the toner cartridge is arranged between the paper output tray and the paper feed tray.

However, in this image forming apparatus, because the fixing device is positioned below the developer unit, heat generated at the fixing device rises to the developer unit. This may cause the developer unit to be heated disadvantageously, and as a result heat deterioration of the developer may occur. Further, because this image forming apparatus is configured such that the toner cartridge is arranged between the paper output tray and the paper feed tray, the size of the whole apparatus becomes disadvantageously large in a horizontal direction.

In view of the foregoing drawbacks of the prior art, the present invention seeks to provide an upright-type image forming apparatus which can restrict an increase in the size of the apparatus in the horizontal direction as well as heat deterioration of the developer.

SUMMARY OF THE INVENTION

According to the present invention, there is provided an image forming apparatus comprising a recording sheet storage unit for storing recording sheets substantially in an upright position, an image forming unit which forms an image on a recording sheet conveyed from the recording sheet storage unit, and a recording sheet receiving unit for storing the recording sheet conveyed from the image forming unit substantially in an upright position. In the image forming apparatus, a paper conveyance passage for conveying the recording sheet extends upward from a lower portion of the recording sheet storage unit toward the recording sheet receiving unit. The image forming unit positioned on the paper conveyance passage comprises a fixing device and a developer unit at least including a developer carrier, and the fixing device is arranged above the developer unit. Further, a developer receptacle for storing developer that is supplied to the image forming unit is arranged adjacent to one longitudinal end of the developer carrier.

With this configuration of the image forming apparatus, the developer receptacle is arranged adjacent to one longitudinal end of the developer carrier. Because the developer receptacle is not positioned between the recording sheet storage unit and the recording sheet receiving unit, it is possible to reduce the distance between the recording sheet storage unit and the recording sheet receiving unit to the extent corresponding to the size of the developer receptacle, thereby reducing the size of the image forming apparatus in the horizontal direction. Further, because the fixing device is arranged above the developer unit at least including the developer carrier, the developer carrier, etc. of the developer unit are not heated by the heat generated and rising from the fixing device. This can prevent heat deterioration of the developer.

According to the present invention, it is possible to reduce the size of the image forming apparatus in the horizontal direction. It is also possible to prevent heat deterioration of the developer due to heat generated and rising from the fixing device.

Other features and advantages of the present invention will be apparent from the following description taken in conjunction with the accompanying drawings.

BRIEF DESCRIPTION OF THE DRAWINGS

Other objects and aspects of the present invention will become more apparent by describing in detail illustrative, non-limiting embodiments thereof with reference to the accompanying drawings, in which:

FIGS. 3A and 3B are vertical sections of the laser printer, in which FIG. 3A shows a state where a process cartridge is attached to the laser printer, and FIG. 3B shows a state where the process cartridge is detached from the laser printer;

FIGS. 6A and 6B are front views of a toner cartridge to be detachably mounted in a toner cartridge storage section, in which FIG. 6A shows a state where an operating handle is in an engaged position, and FIG. 6B shows a state where the operating handle is in a disengaged position;

FIGS. 8A and 8B are vertical sections of the toner cartridge as seen from the front side, in which FIG. 8A shows a state where the operating handle is in the engaged position, and FIG. 8B shows a state where the operating handle is in the disengaged position;

FIGS. 10A and 10B are rear views of the toner cartridge, in which FIG. 10A shows a state where the operating handle is in the engaged position, and FIG. 10B shows a state where the operating handle is in the disengaged position;

FIGS. 11A and 11B are front views of the toner cartridge storage section, in which FIG. 11A shows a state where a shutter member is released, and FIG. 11B shows a state where the shutter member is closed;

FIGS. 12A and 12B show the toner cartridge received in the toner cartridge storage section, in which FIG. 12A shows a state where the operating handle is in the engaged position, and FIG. 12B shows a state where the operating handle is in the disengaged position;

FIGS. 13A and 13B are perspective views partly showing the inner lower structure of the toner cartridge storage section as shown in FIGS. 11A and 11B, in which FIG. 11A shows a state where the shutter member is released, and FIG. 11B shows a state where the shutter member is closed.

DETAILED DESCRIPTION OF THE INVENTION

One preferred embodiment of the present invention will be described in detail with reference to the attached drawings.

Exterior of Laser Printer

Figure 1:
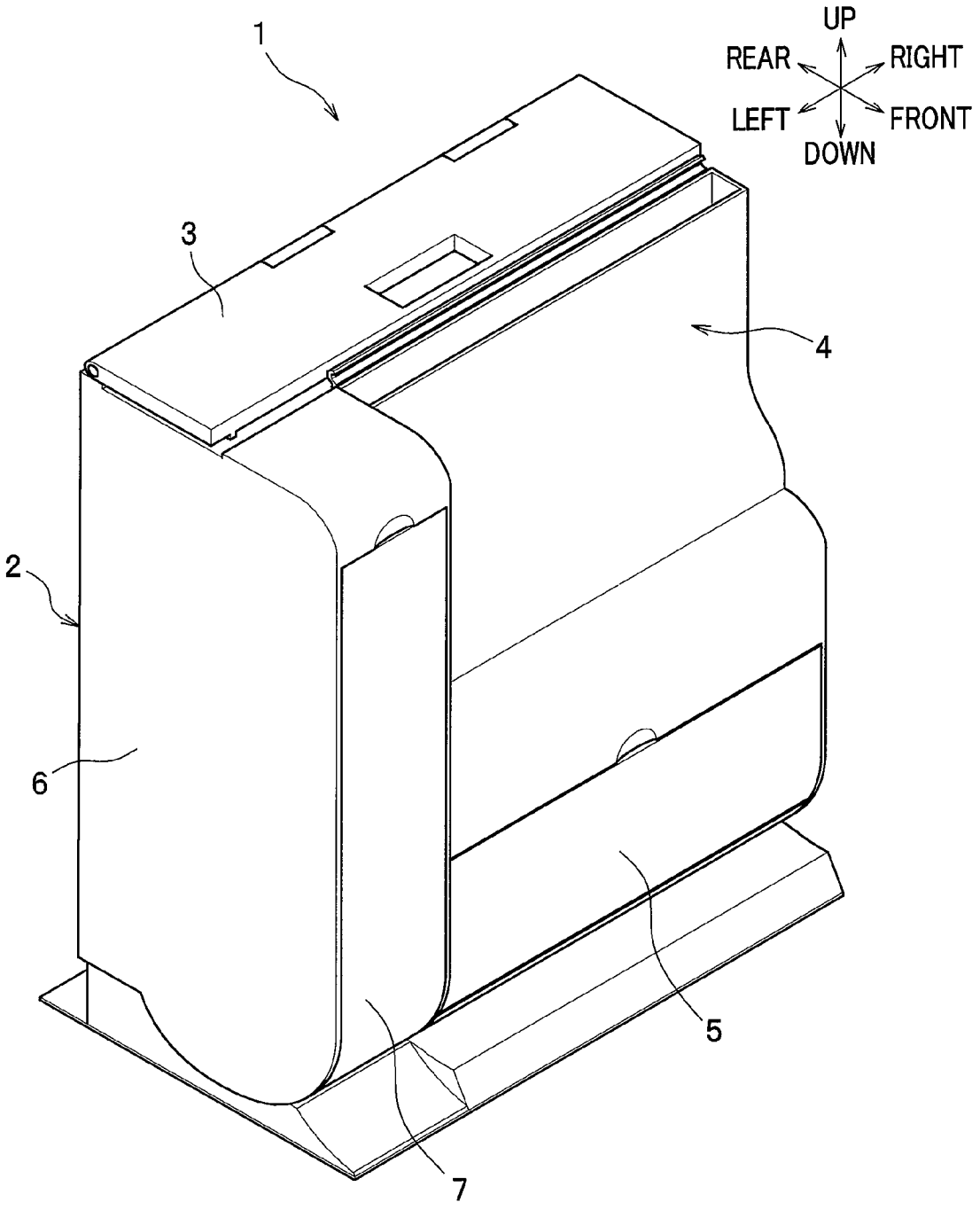
FIG. 1 is a perspective view of a laser printer as an image forming apparatus according to one embodiment of the present invention.
Figure 2:
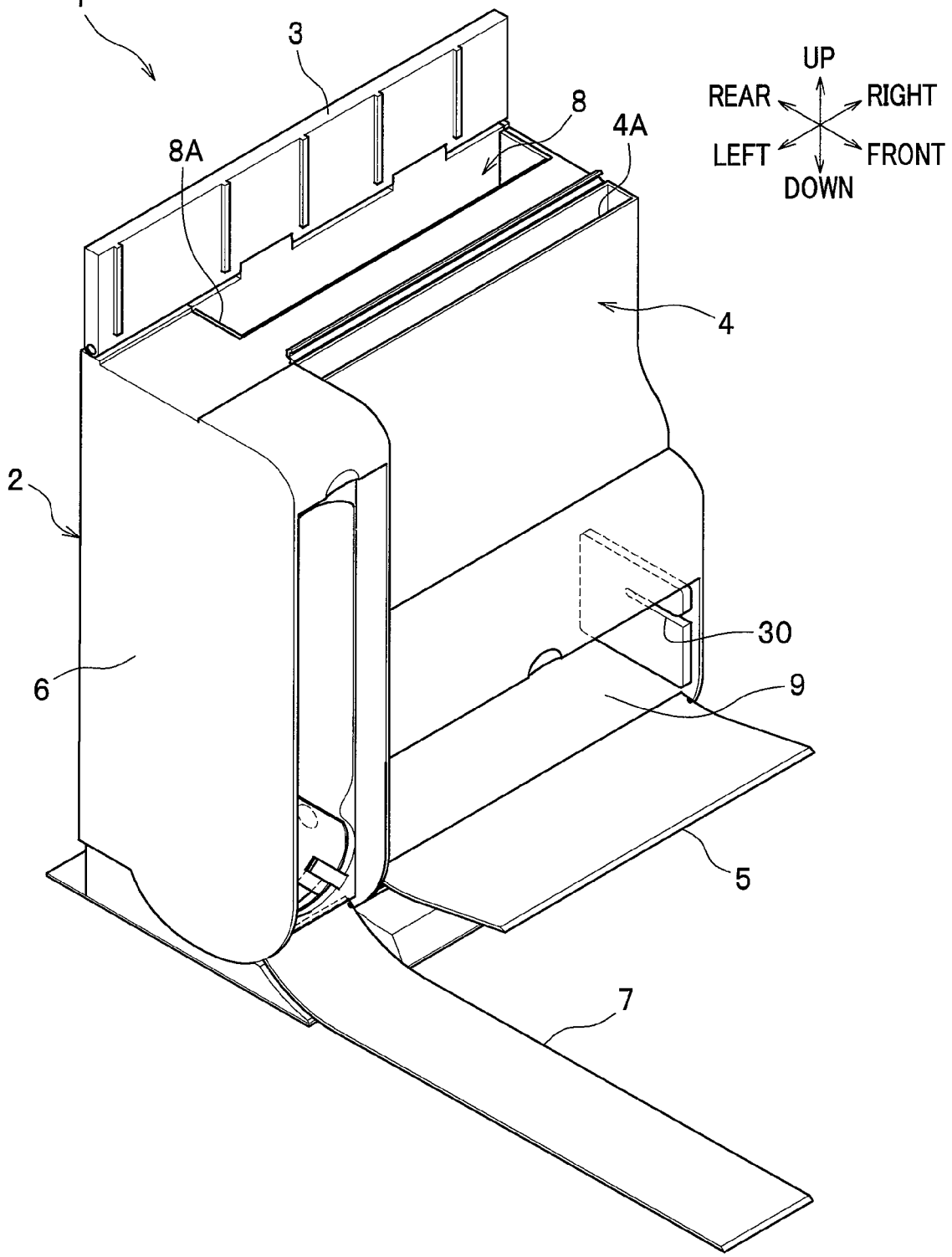
FIG. 2 is a perspective view showing the laser printer of FIG. 1 with a top cover, a front cover, and a front side cover opened.

As seen in FIGS. 1 and 2, an image forming apparatus according to one embodiment of the present invention is provided as an upright-type laser printer 1, which has a relatively short length in the front-back direction compared to the right-and-left direction and the height of which is tall.

The laser printer 1 has a main body casing 2. A top cover 3 is provided at an upper part of the main body casing 2, and a paper output tray 4 is positioned at a front upper part of the main body casing 2. Provided at a front lower part of the main body casing 2 is a front lower cover 5 which is pivotally supported in the main body casing 2 to open and close a space for attaching a process cartridge 11 to be described later. A toner cartridge storage section 6 in the form of a longitudinal box is positioned at the left side of the main body casing 2 as seen from the front side of the laser printer 1, and a front side cover 7 is pivotally supported to open and close a front opening of the toner cartridge storage section 6.

As seen in FIG. 2, the rear end portion of the top cover 3 is pivotally connected to the upper end portion of a paper feed tray 8 that is arranged in an upright position. When lifting the front end portion of the top cover 3 in the upward direction, a paper loading opening 8A is released at the upper end of the paper feed tray 8.

The paper output tray 4 is substantially parallel to the paper feed tray 8 and arranged in an upright position. The paper output tray 4 is positioned ahead of the paper feed tray 8 so that the paper feed tray 8 and the paper output tray 4 are arranged back and forth. A paper output opening 4A opens at the upper end of the paper output tray 4.

The front lower cover 5 is pivotally connected at its lower end portion to the lower part of the main body casing 2, so that when pivotally rotating the upper end portion of the front lower cover 5 in the downward direction, an attachment opening 9 for the process cartridge 11 is released.

The front side cover 7 is pivotally supported at its lower end portion to the lower part of the toner cartridge storage section 6. When pivotally rotating the upper end portion of the front side cover 7 in the downward direction, atoner cartridge 40 to be described later can be removed from the main body casing 2 by sliding it in the forward direction.

Internal Structure of Laser Printer

Figure 3A:
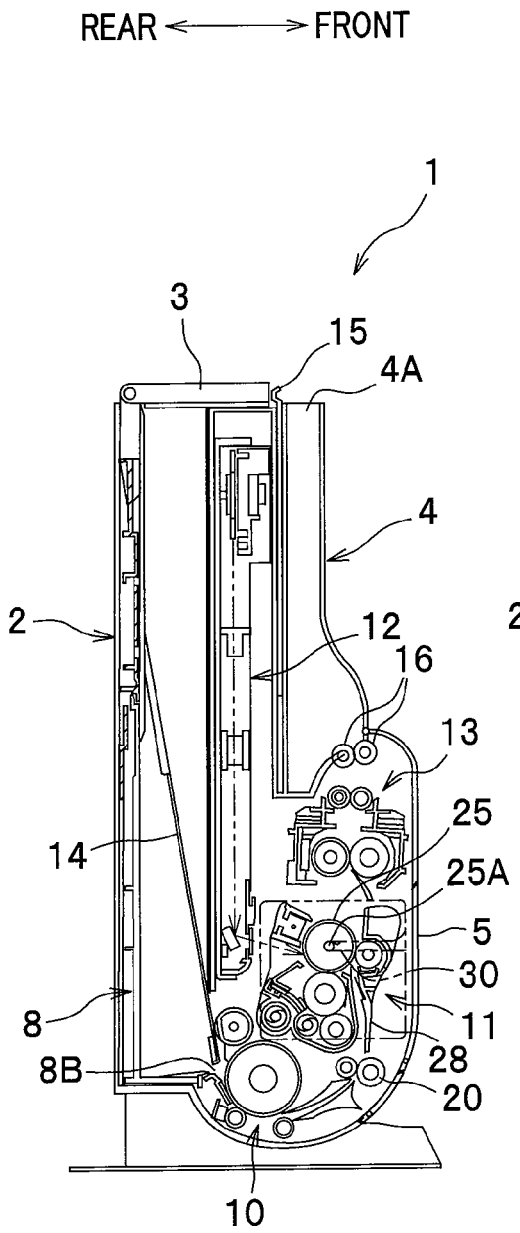
Figure 3B:
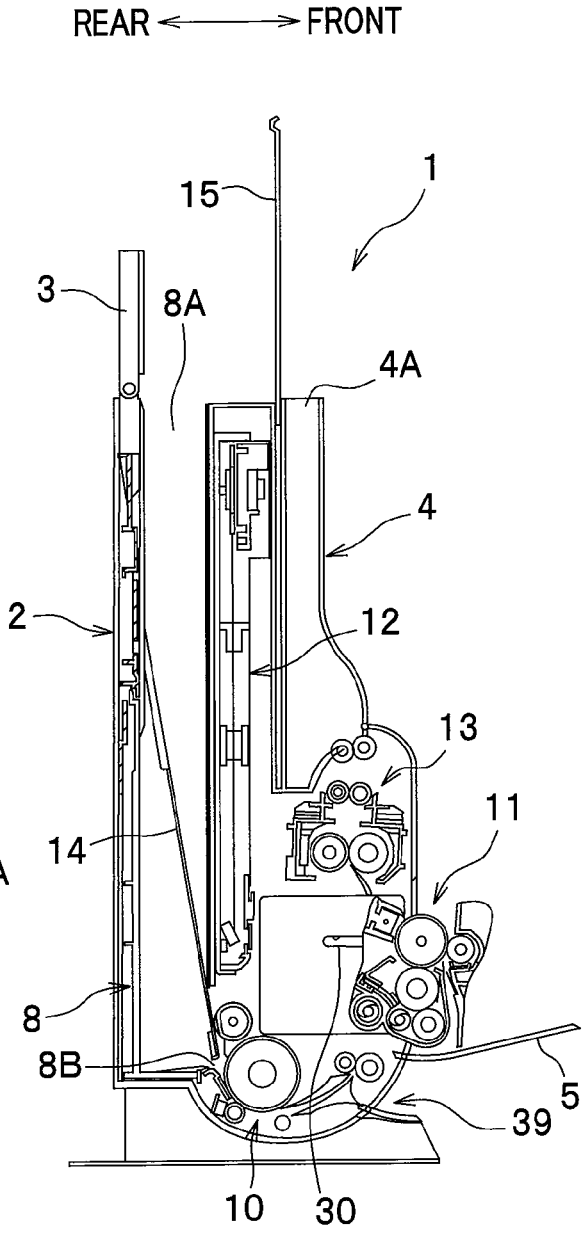

As seen in FIGS. 3A and 3B, a feeder unit 10, the process cartridge 11 as an example of the image forming unit, a scanner unit 12, and a fixing device 13 are arranged in the main body casing 2. The feeder unit 10 pulls out a paper (not shown) downward from the paper feed tray 8 and feeds the paper to the process cartridge 11. The process cartridge 11 forms an image on the paper to be fed from the feeder unit 10. The paper output tray 4 is also arranged in the main body casing 2 so as to receive and store papers on which images are formed by the image forming unit.

Structure of Paper Feed Tray

The paper feed tray 8 as a recording sheet storage unit stores a stack of papers in a state where the papers are placed substantially in an upright position. A paper pressure plate 14 is provided in the paper feed tray 8 so as to press the lower end of the stack of papers toward a paper feed opening 8B provided at the lower part of the paper feed tray 8. The paper feed tray 8 can be pulled out upward from the main body casing 2 (See FIG. 4).

Structure of Paper Output Tray

The paper output tray 4 as a recording sheet receiving unit stores printed papers that are sequentially fed from the fixing device 13 in a sate where the papers are placed substantially in an upright position. The paper output tray 4 forms an installation space for the scanner unit 12 with the paper feed tray 8. The lower end of the paper output tray 4 is positioned higher than the lower end of the paper feed tray 8. Provided downward of the paper output tray 4 are the feeder unit 10, the process cartridge 11, and the fixing device 13, which are arranged in this order along a paper conveyance passage and from the bottom of the laser printer 1.

The paper output opening 4A at the upper end of the paper output tray 4 is positioned substantially at the same height as the upper end of the paper feed tray 8, and papers are stored in the paper output tray 4 with the upper ends thereof protruding from the paper output opening 4A. For this reason, a paper support 15 is provided just behind the paper output opening 4A of the paper output tray 4. The paper support 15 is slidably mounted so that when in use it is pulled upward from the main body casing 2 to thereby prevent printed papers from falling over. Provided at the front lower side of the paper output tray 4 are a pair of paper output rollers 16, 16 for feeding a paper to the paper output tray 4 (see FIG. 4). The lower end (bottom portion) of the paper output tray 4 is positioned higher than the lower end (bottom portion) of the paper feed tray 8.

Structure of Feeder Unit

Figure 4:
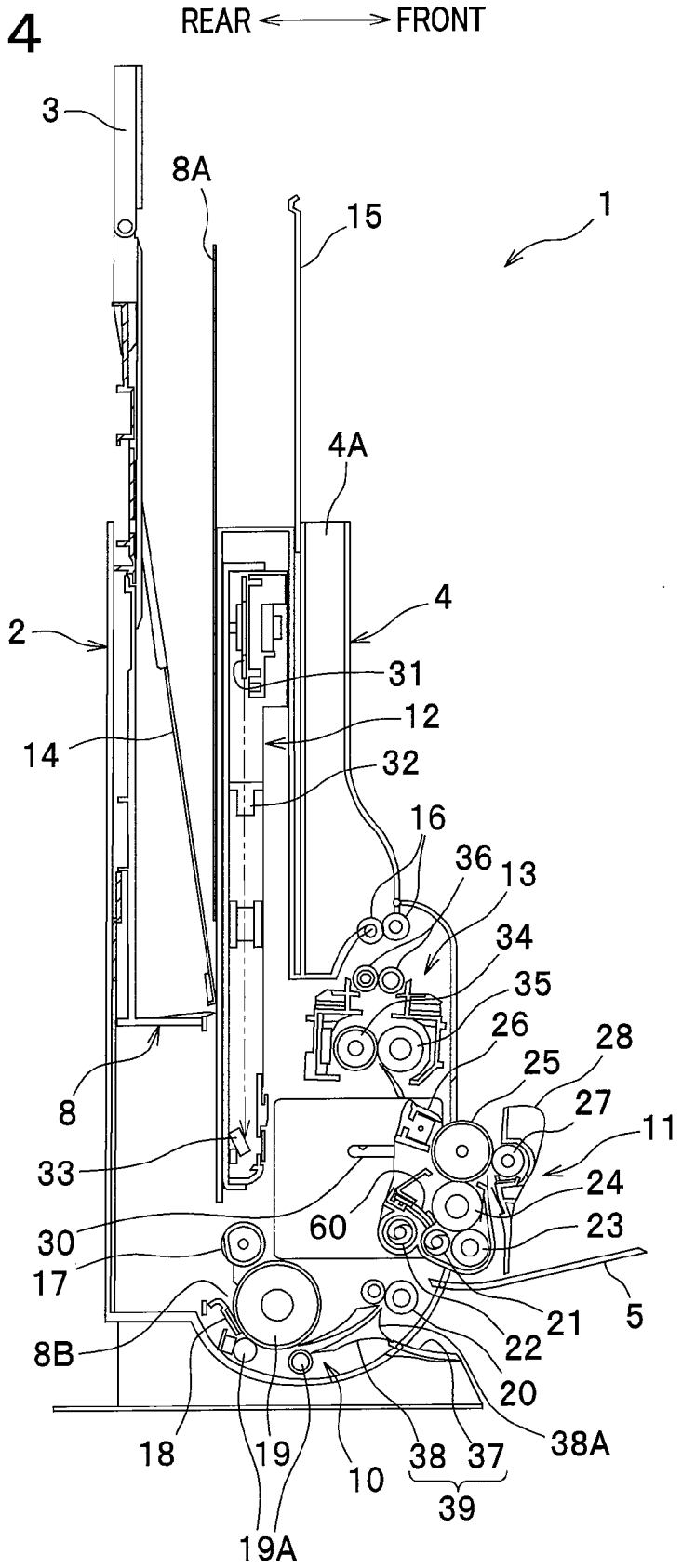
FIG. 4 is a vertical section of the laser printer showing a state where a paper feed tray is pulled out from the laser printer in an upward direction.

The feeder unit 10 is positioned adjacent to the paper feed opening 8B at the lower part of the paper feed tray 8. As best seen in FIG. 4, the feeder unit 10 includes a feed roller 17 which pulls out a paper downward from the paper feed tray 8 and feeds the same to the subsequent process, a separation pad 18 and a separation roller 19 between which the lower end of the paper (i.e., leading end of the paper along the conveyance direction) is fed so that the paper is separated and fed on one-by-one basis, a registration roller 20 with which a leading end of the paper that is fed from the separation roller 19 is brought into contact so that the paper is temporarily constrained and thereafter conveyed upward to the process cartridge 11. The registration roller 20 is positioned ahead of the separation roller 19 closer to the front side of the main body casing 2, and conveys the paper upward to the process cartridge 11.

Structure of Process Cartridge

A toner cartridge 40 to be described later as an embodiment of a developer receptacle is separable from the process cartridge 11. The process cartridge 11 includes a toner feed auger 21 and a toner collect auger 22 as an example of a developer carrying member, a feed roller 23, a developing roller 24 as an example of a developer carrier, a photosensitive drum 25, a charger 26, and a transfer roller 27.

Figure 5:
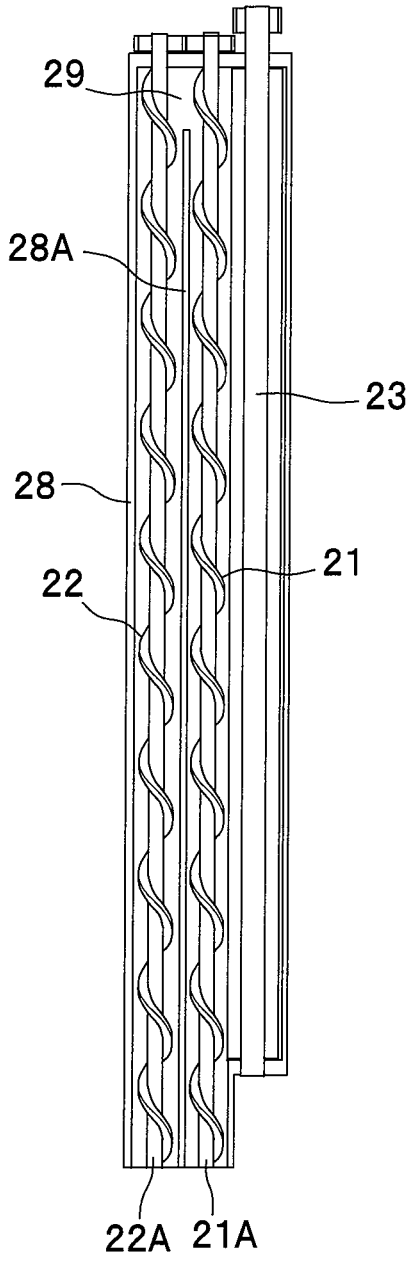
FIG. 5 is a top view showing the configuration of a toner feed auger, a toner collect auger, and a feed roller.

The toner feed auger 21, the toner collect auger 22, and the feed roller 23 supply the developing roller 24 with toner (developer) stored in the toner cartridge 40 to be described later as well as collect remaining toner and return it into the toner cartridge 40. As best seen in FIG. 5, the toner feed auger 21, the toner collect auger 22, and the feed roller 23 are accommodated in a development chamber 29 that is defined in a cartridge body 28. The development chamber 29 is arranged just below the developing roller 24 as shown in FIG. 4.

As seen in FIG. 5, the toner feed auger 21 is adjacent to and parallel with the feed roller 23. When the toner feed auger 21 is actuated, for example, by rotating the rotational shaft 21A in the clockwise direction of FIG. 4, toner is carried in the horizontal direction from one end of the toner feed auger 21 to the other. In other words, toner is carried axially along the toner feed auger 21 from one lower end of FIG. 4 to the other upper end, so that toner is uniformly axially supplied over the surface of the feed roller 23.

The toner collect auger 22 is adjacent to and parallel with the toner feed auger 21. However, a separation wall 28A formed in the cartridge body 28 is interposed and separates the toner collect auger 22 from the toner feed auger 21. The separation wall 28A divides the development chamber 29 into two half chambers (reference numerical omitted). The toner collect auger 22 rotates in the reverse direction of the toner feed auger 21. When the toner collect auger 22 is actuated by rotating the rotational shaft 22A in the anticlockwise direction of FIG. 4, that is in the reverse rotational direction of the rotational shaft 2A of the toner feed auger 21, toner is carried axially along the toner collect auger 22 from the upper end of FIG. 5 to the other lower end.

As seen in FIG. 5, the two half chambers are communicated to each other at one end (i.e., upper end of FIG. 5) of the development chamber 29, so that remaining toner carried by the toner feed auger 21 axially toward this one end is collected and carried back toward the other end of the development chamber 29.

Detachable Structure of Process Cartridge

The process cartridge 11 is attached to and detachable from the main body casing 2 through the attachment opening 9 when the front lower cover 5 is opened as shown in FIG. 2. As seen in FIGS. 2 to 4, guide grooves 30, 30 are formed in the right and left inner side walls of the main body casing 2 around the attachment opening 9. The guide grooves 30, 30 extend in the forward and backward direction of the main body casing 2. As seen in FIG. 3A, the rotational shaft 25A of the photosensitive drum 25 extends outward from both side surfaces of the cartridge body 28 of the process cartridge 11 so that the both ends of the rotational shaft 25A are slidably guided along the guide grooves 30, 30 of the main body casing 2, thereby allowing sliding engagement and disengagement of the process cartridge 11 relative to the main body casing 2.

According to this detachable structure, the process cartridge 11 is inserted from the attachment opening 9 provided at the front side of the laser printer 1, and it is attached to a predetermined position of the main body casing 2 below the fixing device 13. See FIG. 3A. Meanwhile, the process cartridge 11 is easily removed from the predetermined position of the main body casing 2 by pulling out the process cartridge 11 through the attachment opening 9 of the laser printer 1. See FIG. 3B.

Operation of Process Cartridge

In the process cartridge 11, the toner feed auger 21 as shown in FIG. 5 supplies toner to the surface of the feed roller 23. As seen in FIG. 4, toner that is supplied to the surface of the feed roller 23 makes a frictional contact with the developing roller 24 and is charged positively. Therefore, the toner adheres and is deposited on the surface of the developing roller 24. A doctor blade 60 wipes off the deposited toner and restricts the thickness of the toner so that a thin toner layer having a constant thickness is formed on the developing roller 24.

The photosensitive drum 25 includes a photosensitive layer having positive charge characteristics. When the charger 26 generates and applies a corona discharge from a charge wire made of tungsten, etc., the photosensitive layer formed on the surface of the photosensitive drum 25 is uniformly charged in the plus polarity. The positively charged photosensitive layer on the photosensitive drum 25 is then exposed to a laser beam irradiated from the scanner unit 12 based on image data. This exposure process lowers the potential of an exposed area on the photosensitive layer, so that a latent image associated with the image data is formed on the photosensitive drum 25.

Plus charged toner carried on the developing roller 24 adheres to the latent image that is formed on the photosensitive layer of the photosensitive drum 25. By this reversal process, a toner image is formed on the photosensitive layer of the photosensitive drum 25. A paper is conveyed along the paper conveyance passage and passes between the photosensitive drum 25 which carries the toner image on the photosensitive layer and the transfer roller 27, during which the toner image is transferred on the paper. The transfer roller 27 includes a roller shaft, which is made of metal and covered with a rubber material. When a transfer bias is applied to the transfer roller 27, the toner image formed on the photosensitive drum 25 is transferred to the paper.

Structure of Scanner Unit

As best seen in FIG. 4, the scanner unit 12 is arranged between the paper output tray 4 and the paper feed tray 8. The scanner unit 12 is installed in an upright position using a dead space formed between the paper output tray 4 and the paper feed tray 8. The scanner unit 12 includes a polygon mirror 31 which is rotatively driven to perform high speed scanning, a lens 32, a reflecting mirror 33, etc. The photosensitive layer of the photosensitive drum 25 is exposed when a laser beam is emitted and reflected at the reflecting mirror to irradiate the photosensitive layer based on the image data.

The polygon mirror 31 is arranged such that the rotation shaft of the polygon mirror 31 extends in the horizontal direction.

Structure of Fixing Device

The fixing device 13 is arranged above the process cartridge 11. The fixing device 13 includes a heating roller 34 and a pressure roller 35 which are positioned oppositely and rotate to pinch and convey a paper toward the paper output tray 4, and a pair of conveyance rollers 36, 36. The pair of conveyance rollers 36, 36 are positioned downstream of the paper conveyance passage so as to receive the paper from the heating roller 34 and the pressure roller 35 and to convey the same to the pair of paper output rollers 16, 16.

Operation of Fixing Device

A paper on which a toner image has been transferred between the photosensitive drum 25 and the transfer roller 27 in the process cartridge 11 is conveyed and passes between the heating roller 34 and the pressure roller 35 provided in the fixing device 13. During this time the toner image formed on the paper is thermally fixed by the heating roller 34.

Paper Conveyance Passage

The paper conveyance passage along which a paper is conveyed extends from the paper feed tray 8 toward the paper output tray 4. The paper conveyance passage has a substantially U-shaped configuration and protrudes downward from the paper feed tray 8 and the paper output tray 4. The paper conveyance passage is defined by the feed roller 17, the separation roller 19, guide rollers 19A, a paper guide 38, the registration roller 20, the photosensitive drum 25 and the transfer roller 27, the heating roller 34 and the pressure roller 35, the conveyance rollers 36, 36, and the paper output rollers 16, 16, etc. Of this conveyance passage, the passage from the registration roller 20 to the paper output rollers 16, 16 is directed to the upward direction as shown in FIG. 3.

According to this embodiment, the guide rollers 19A, 19A are positioned oppositely to the separation roller 19. The feed roller 17 is a roller by which a paper stored in the paper feed tray 8 is conveyed downward through the paper feed opening 8B provided at the lower part of the paper feed tray 8. When a paper is conveyed along the paper conveyance passage and passes between the separation roller 19 and the guide roller 19A and also through the paper guide 38, the paper is curved into a U-shape with the front side and the reverse side thereof being turned over at the leading end.

The paper conveyance passage having a substantially U-shaped configuration and protruding downward indicates that the paper conveyed from the paper feed tray 8 is guided downward and then the paper is reversed while the leading end of the paper is curved into a U-shape, and thereafter the paper is guided and conveyed upward. The outlet of the paper conveyance passage is formed between the paper output rollers 16, 16. Further, the paper feed opening 8B is provided at the lower part of the paper feed tray 8, and the paper discharge opening (reference numeral omitted) of the paper output tray 4 is positioned higher than the paper feed opening 8B of the paper feed tray 8.

In other words, the substantially U-shaped paper conveyance passage directly connects between the paper feed opening 8B of the paper feed tray 8 and the paper discharge opening of the paper output tray 4.

Further, in this U-shaped paper conveyance passage, the vertical distance from the paper feed opening 8B of the paper feed tray 8 to the bottom portion of the conveyance passage (also referred to as a "downward conveyance passage") is smaller than the vertical distance from the bottom portion of the conveyance passage to the paper discharge opening of the paper output tray 4 (also referred to as an "upward conveyance passage"). Therefore, the registration roller 20, the process cartridge 11, and the fixing device 13 can be arranged in this order along the upward conveyance passage.

To be more specific, the U-shaped paper conveyance passage is configured such that the upward conveyance passage is longer in the vertical distance than the downward conveyance passage. This makes it possible to reduce the vertical size of the laser printer 1 around the paper feed tray 8 when compared with the configuration in which the upward conveyance passage is shorter in the vertical distance than the downward conveyance passage. Therefore, it is possible to arrange the paper feed tray 8 in a lower position of the main body casing 2, which facilitates a paper loading operation into the paper feed tray 8 and thereby improves the operationality of the laser printer 1.

Especially, according to this embodiment, the paper feed tray 8 is pulled out upward from the main body casing 2 upon loading papers into the paper feed tray 8. In this instance, the paper feed tray 8 is readily pulled out upward and the paper loading operation is easily performed if the paper feed tray 8 is arranged in a lower position of the main body casing 2 as described above.

Structure of Manual Paper Feed Unit

As seen in FIG. 4, a lower cover 37 is pivotally connected to the lower part of the main body casing 2. The lower cover 37 is positioned below the front lower cover 5 and covers the region around the registration roller 20. The lower cover 37 has an arcuately curved section, the lower end of which is pivotally supported in the main body casing 2. In order to form a continuous surface with the lower end portion of the lower cover 37 opened, in the main body casing 2 the paper guide 38 has a guide surface 38A which curves upward toward the registration roller 20.

When the lower cover 37 is pivotally rotated downward to the position of FIG. 4, the arcuately curved inner surface of the lower cover 37 comes in contact with the guide surface 38A of the paper guide 38 to form a continuous surface so that a paper is guided along this continuous surface and supplied toward the registration roller 20. Therefore, a manual paper feed unit 39 is formed at the front side of the laser printer 1 by the lower cover 37 and the paper guide 38.

Structure of Toner Cartridge

Figure 6A:
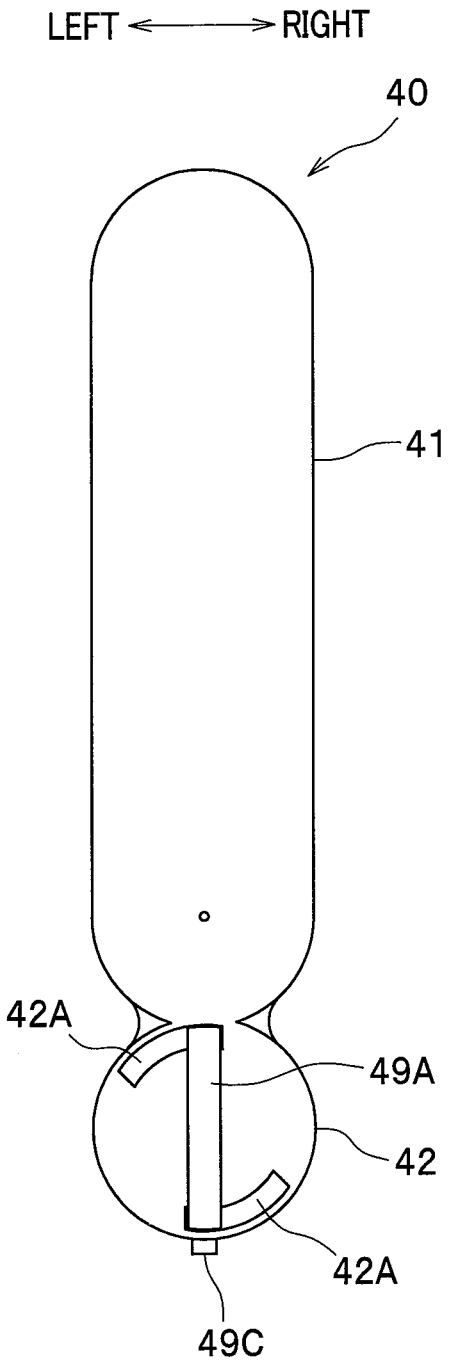
Figure 6B:
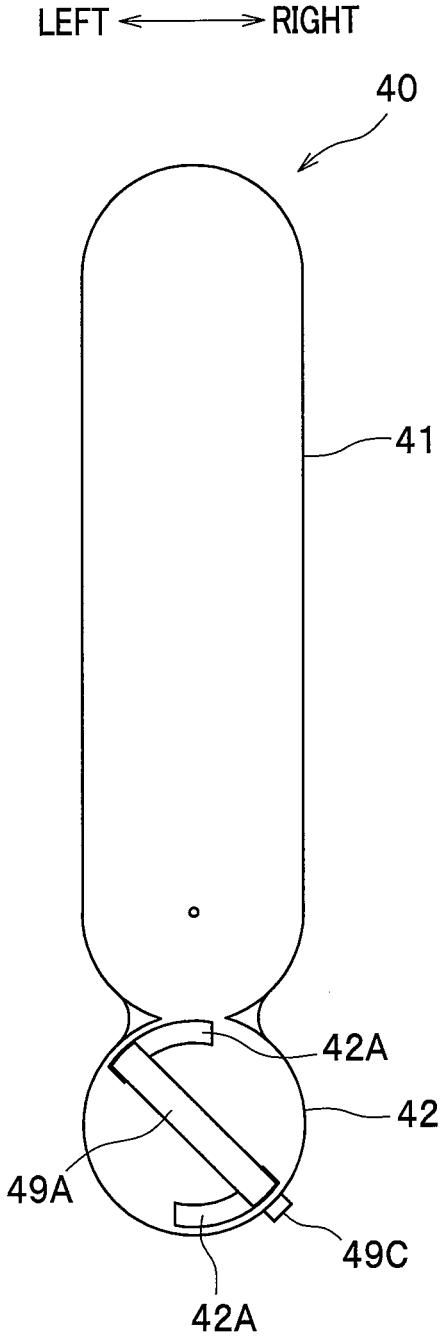
Figure 7:
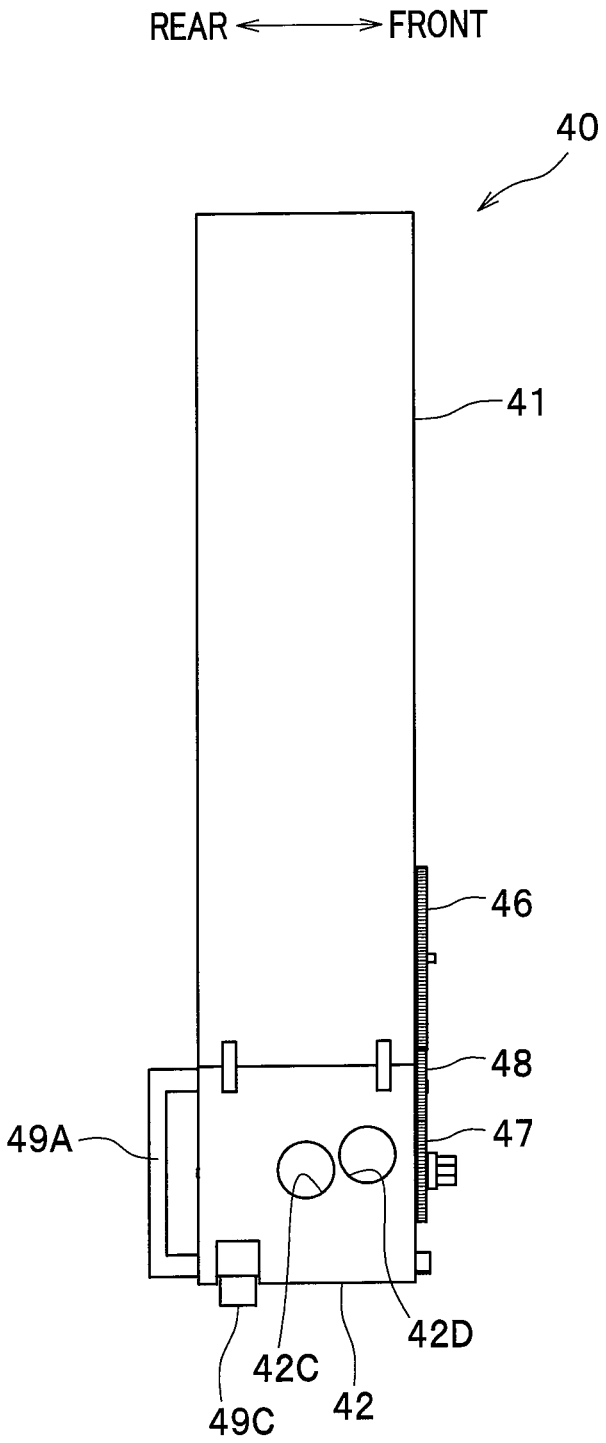
FIG. 7 is a right side view of the toner cartridge.

The toner cartridge 40 has a front shape as shown in FIGS. 6A and 6B and a right side elevation as shown in FIG. 7. The toner cartridge 40 is received in the toner cartridge storage section 6 as shown in FIG. 1 in a such a position to be adjacent to one longitudinal end of the developing roller 24 (see FIG. 3). To be more specific, the toner cartridge 40 is positioned on the lower end side of FIG. 5 adjacent to the toner feed auger 21 and the toner collect auger 22, and is received in the toner cartridge storage section 6 as shown in FIG. 1.

As seen in FIGS. 6A, 6B and FIG. 7, the toner cartridge 40 includes a toner receptacle unit 41 in the form of a longitudinal box, and a toner feed unit 42 provided below and in communication with the toner receptacle unit 41. The toner feed unit 42 is in the form of a hollow cylinder. The toner receptacle unit 41 is a receptacle for storing toner as developer. The toner feed unit 42 receives toner from the toner receptacle unit 41, and supplies the toner feed auger 21 with toner as well as collects remaining toner from the toner collect auger 22.

Figure 8A:
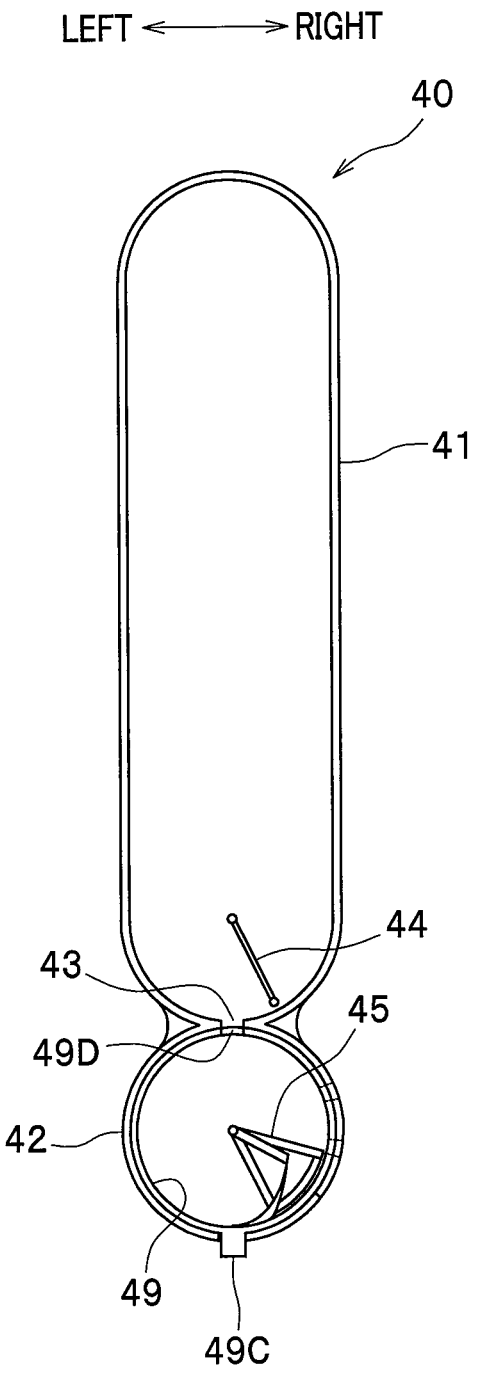
Figure 8B:
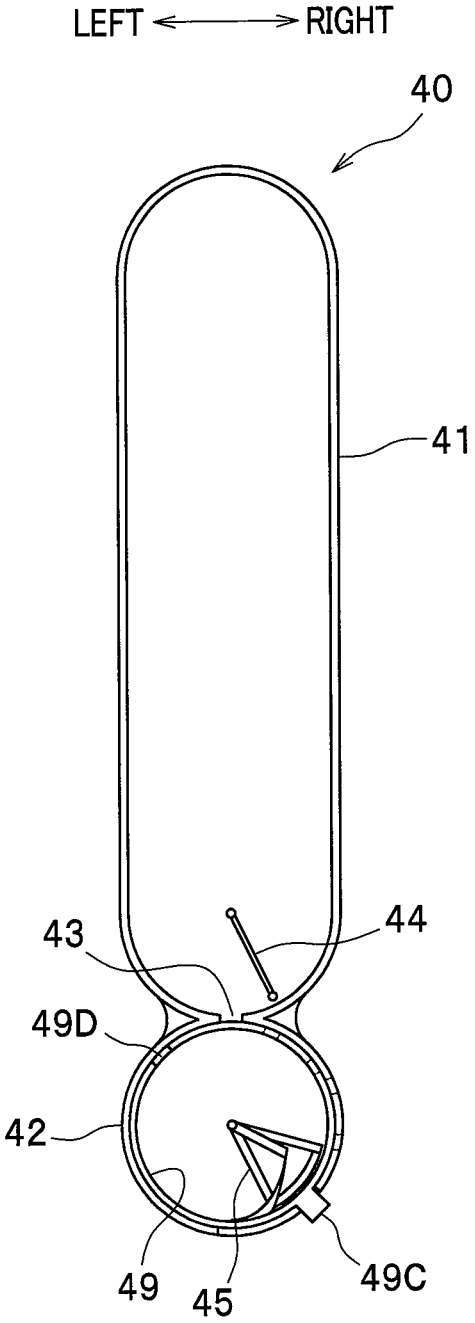

As best seen in the front-side vertical sections of FIGS. 8A and 8B, the toner receptacle unit 41 and the toner feed unit 42 are in communication with each other through a slit-shaped communication hole 43, so that toner stored in the toner receptacle unit 41 is filled into the toner feed unit 42 through the communication hole 43. An upper agitator 44 is provided in the toner receptacle unit 41 so as to force toner out from the toner receptacle unit 41 though the communication hole 43. Similarly, a lower agitator 45 is provided in the toner feed unit 42 so as to agitate the toner that is supplied from the toner receptacle unit 41 through the communication hole 43.

Figure 9A:
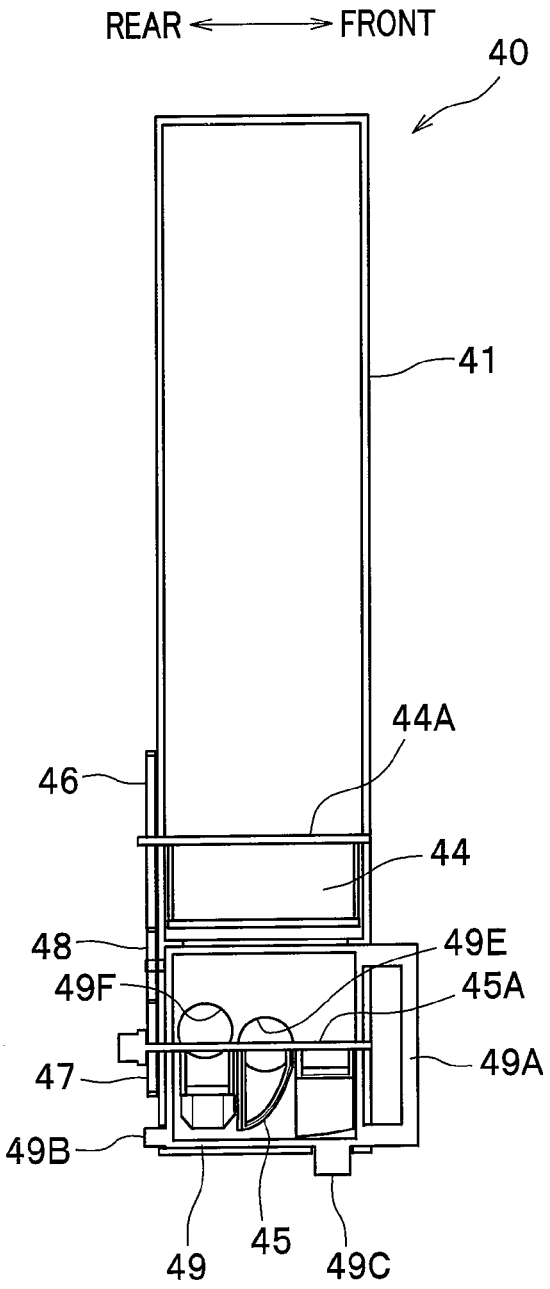
FIG. 9A is a vertical section of the toner cartridge as seen from the left side.
Figure 10A:
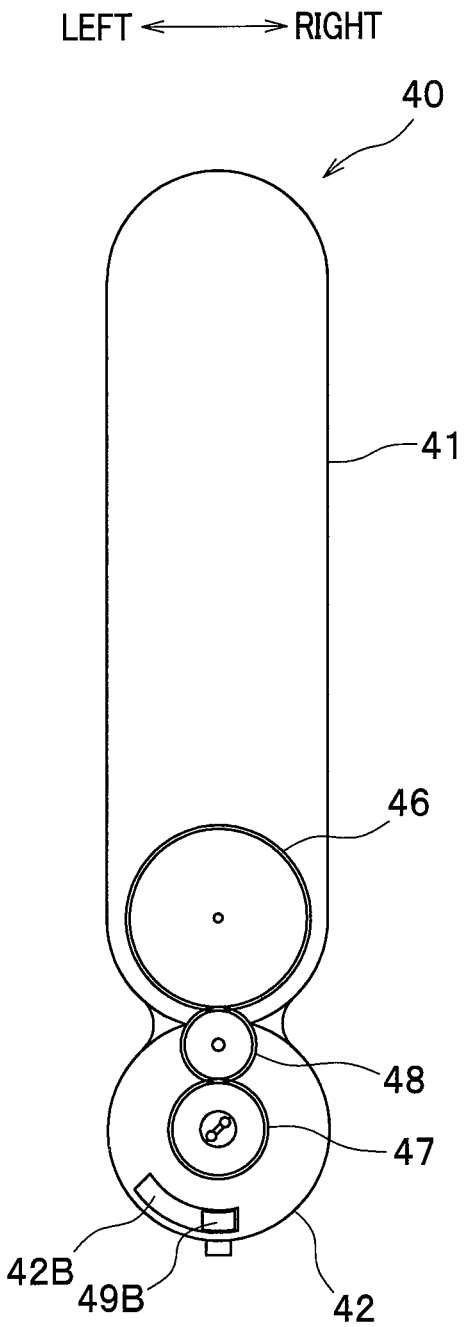
Figure 10B:
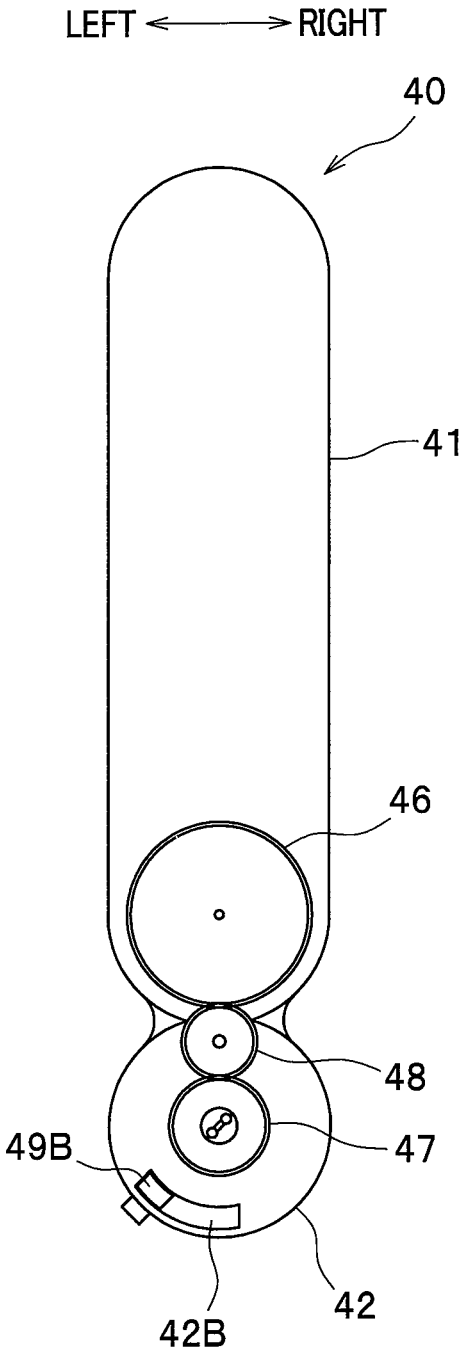

As seen in the vertical section of FIG. 9A and the rear views of FIGS. 10A and 10B, the rotational shaft 44A of the upper agitator 44 is driven by a driving gear 46 provided at the rear side surface of the toner receptacle unit 41, and the rotational shaft 45A of the lower agitator 45 is driven by a driving gear 47 also provided at the rear side surface of the toner receptacle unit 41. The driving gear 46 and the driving gear 47 are meshed with an interlocking gear 48 so that the upper agitator 44 and the lower agitator 45 are synchronously rotated. The driving gear 46 is driven when a driving force is supplied from a motor provided in the printer main body (not shown).

As seen in FIGS. 8A, 8B and FIG. 9A, an inner cylinder 49 is provided in the toner feed unit 42. The inner cylinder 49 is rotatable along the inner periphery of the toner feed unit 42. The inner cylinder 49 is provided with an operating handle 49A at the front end thereof. The operating handle 49A protrudes from the front end of the inner cylinder 49 for manipulating the inner cylinder 49. Provided at the rear end of the inner cylinder 49 is an operating protrusion 49B for restricting the rotational position of the inner cylinder 49. The operating protrusion 49B is fitted into a fitting hole 50B of a shutter member 50 (see FIGS. 13A and 13B) provided in the toner cartridge storage section 6.

An operating protrusion 49C for rotatively manipulating the shutter member 50 to be described later is formed on the front end portion of the outer peripheral surface of the inner cylinder 49. Further, a slit-like toner introducing hole 49D is formed in the peripheral wall of the inner cylinder 49 and extends along the axial direction of the inner cylinder 49.

Figure 9B:
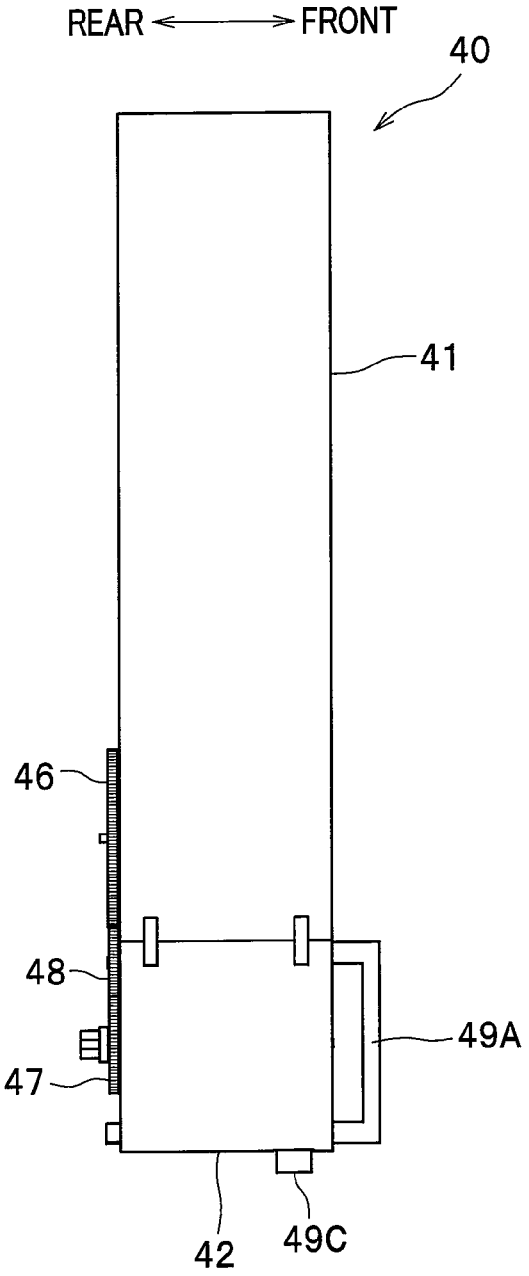
FIG. 9B is a left side view of the toner cartridge.

As best seen in FIGS. 9A and 9B, the operating handle 49A has a substantially lying U-shaped side section. As shown in FIGS. 6A and 6B, both ends of the operating handle 49A extend through arcuate openings 42A, 42A formed in the front side surface of the toner feed unit 42 so that the operating handle 49A becomes rotatable in a predetermined angle range as seen from the front side of the toner feed unit 42.

Similarly, as shown in FIGS. 10A and 10B, the operating protrusion 49B extends through an arcuate opening 42B formed in the rear side surface of the toner feed unit 42 so that the rotating movement of the operating protrusion 49B is restricted at both end portions of the arcuate opening 42B.

When the operating handle 49A is in an engaged position shown in FIG. 6A, as seen in FIG. 8A, the toner introducing hole 49D of the inner cylinder 49 is in conformity with the communication hole 43 so that the tone receptacle unit 41 comes into direct communication with the toner feed unit 42 to thereby allow toner in the toner receptacle unit 41 to be introduced into and filled in the toner feed unit 42. On the contrary, when the operating handle 49A is in a disengaged position shown in FIG. 6B, as seen in FIG. 8B, the toner introducing hole 49D of the inner cylinder 49 is not in communication with the communication hole 43 so that toner is not introduced into the toner feed unit 42.

Figure 11A:
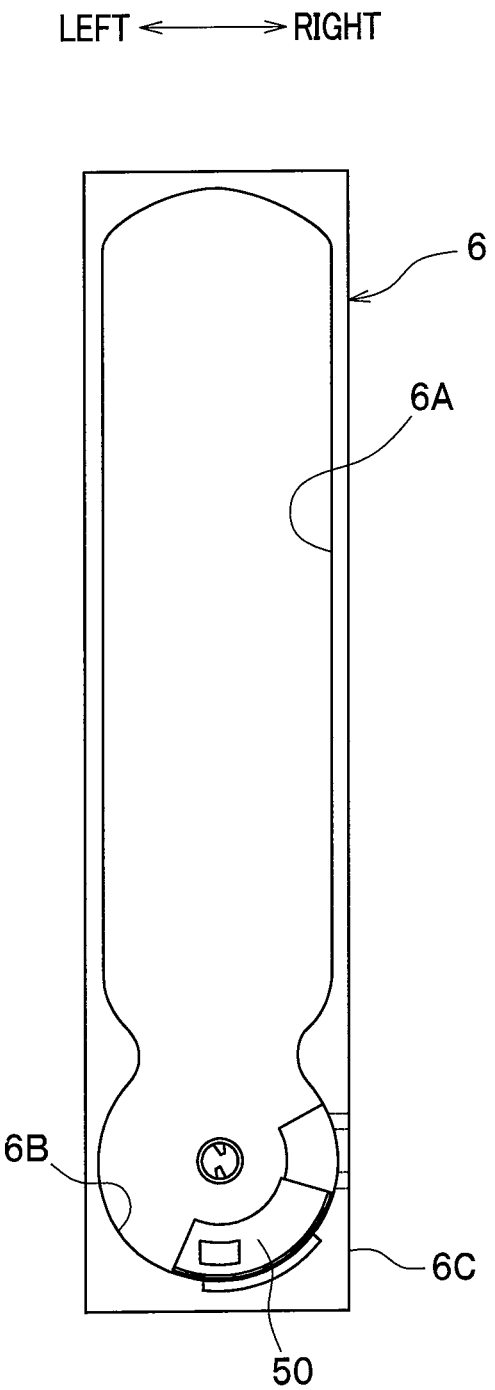
Figure 11B:
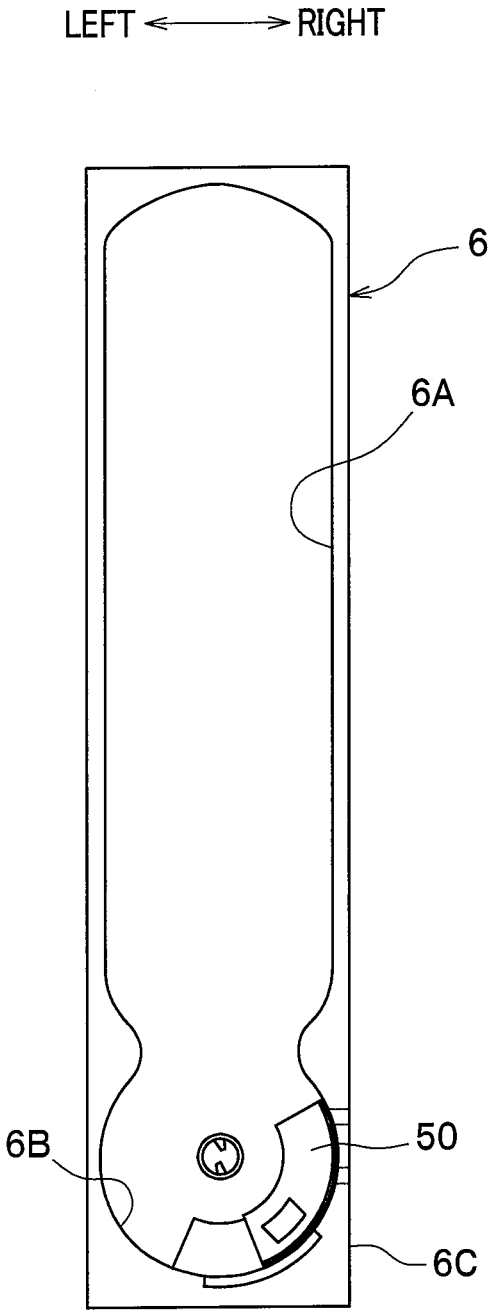
Figure 12A:
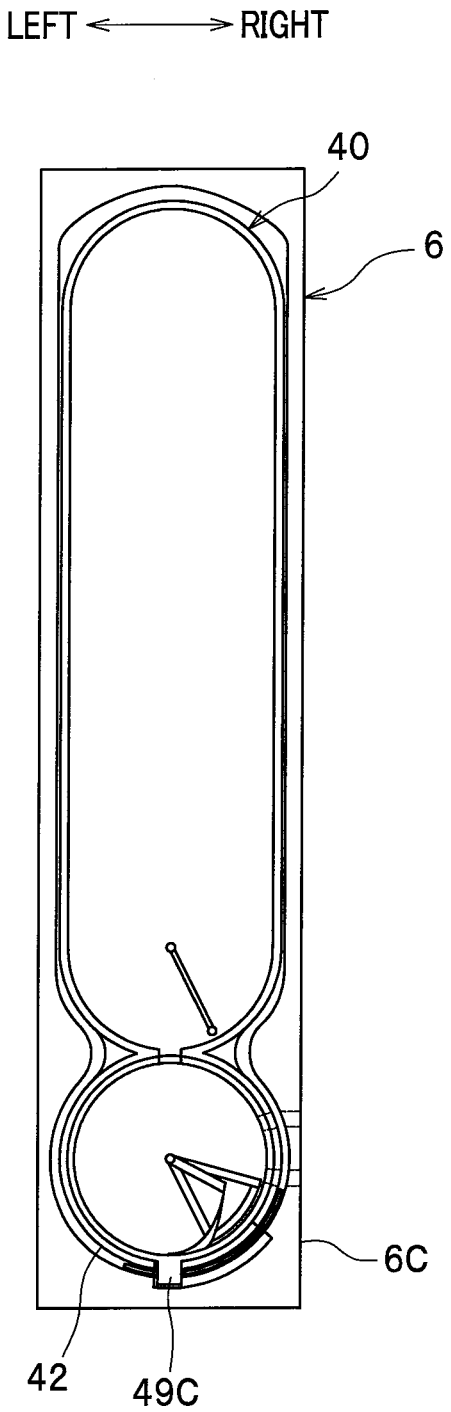
Figure 12B:
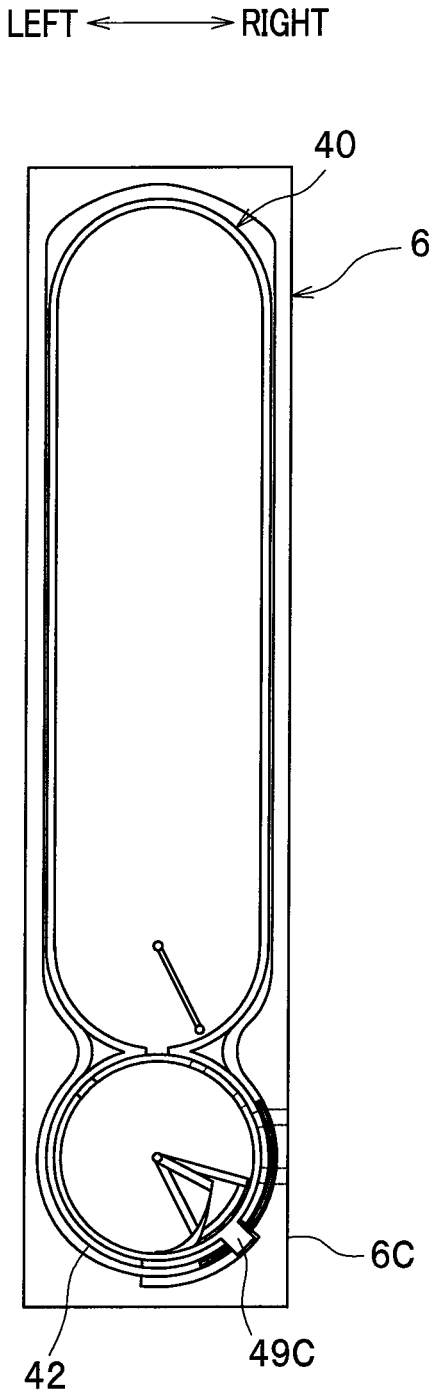

As best seen in FIGS. 11A and 11B, the toner cartridge storage section 6 shown in FIG. 2 includes an upper storage room 6A whose shape corresponds with the front shape of the toner receptacle unit 41, and a lower storage room 6B whose shape corresponds with the front shape of the toner feed unit 42. The upper storage room 6A and the lower storage room 6B are continuously formed to receive therein the toner cartridge 40 as shown in FIGS. 12A and 12B.

Toner Feed/Collect Mechanism

A right side wall lower portion 6C, which constitutes the lower storage room 6B of the toner cartridge storage section 6 as shown in FIGS. 11A and 11B, abuts on one side end of the cartridge body 28 (i.e., lower end of FIG. 5). Further, as a mechanism for supplying the development chamber 29 (see FIG. 5) with toner stored in the toner feed unit 42 of the toner cartridge 40 and for collecting remaining toner from the development chamber 29 and introducing it into the toner feed unit 42, as seen in FIGS. 13A and 13B, a toner feed opening 6D and a toner collect opening 6E are formed in the side wall lower portion 6C of the toner cartridge storage section 6.

As seen in FIG. 7, a toner feed opening 42C and a toner collect opening 42D are formed in the peripheral wall of the toner feed unit 42 at right side of the toner feed unit 42 in a manner corresponding to the toner feed opening 6D and the toner collect opening 6E, respectively. Further, a toner feed opening 49E and a toner collect opening 49F are also formed in the peripheral wall of the inner cylinder 49 as shown in FIG. 9A.

Figure 13A:
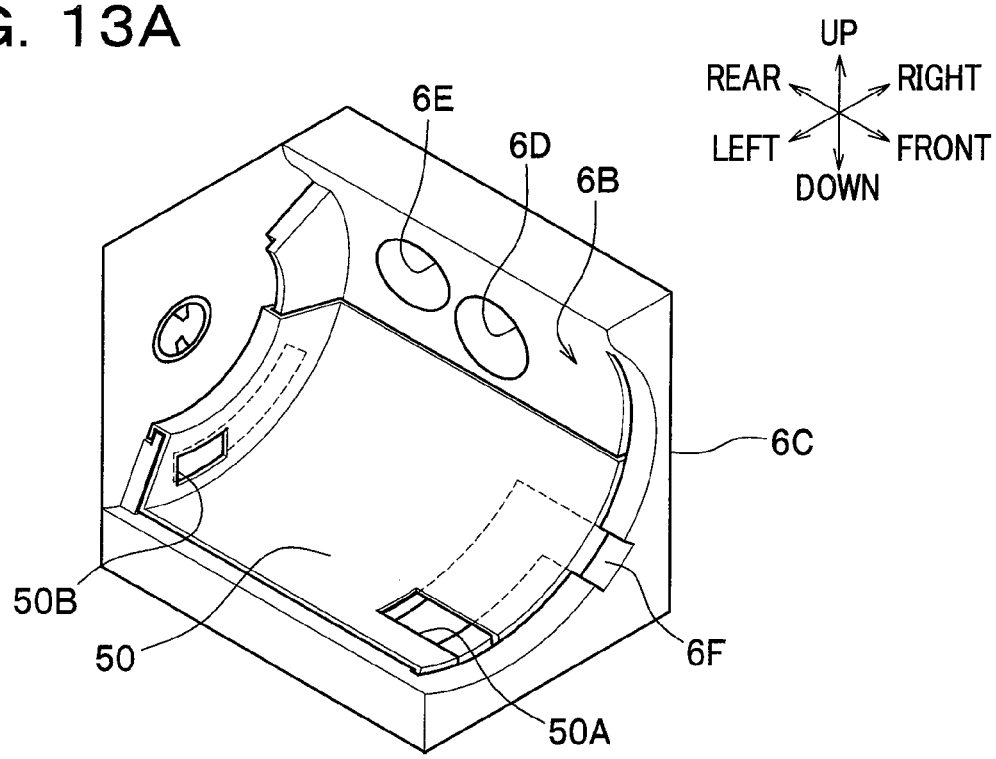
Figure 13B:
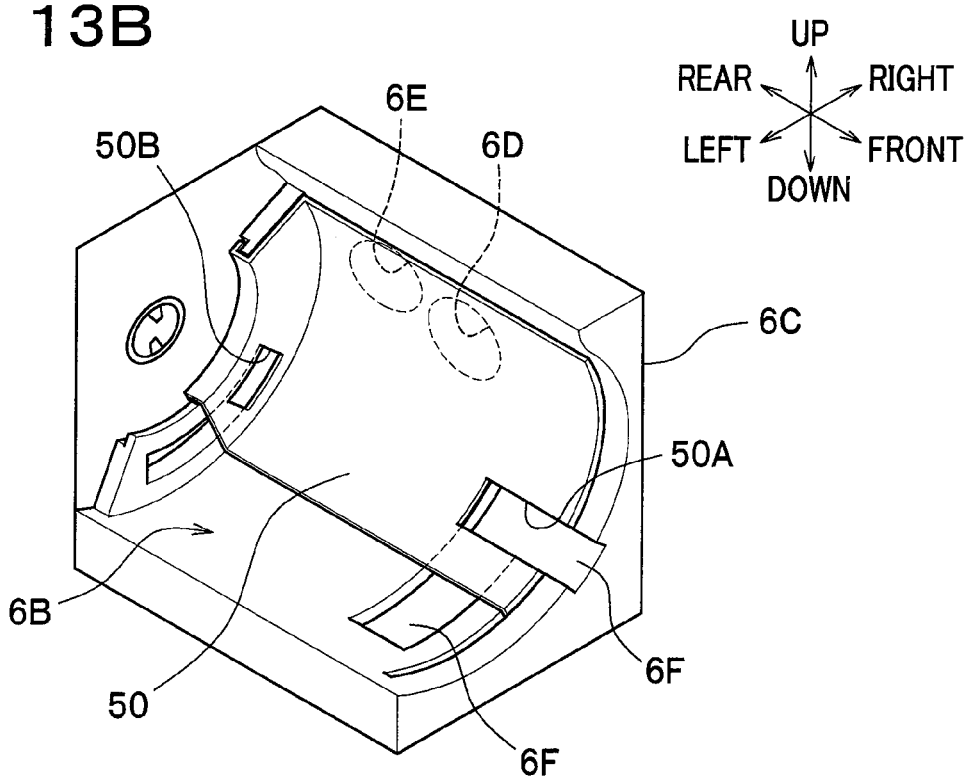

As seen in FIGS. 13A and 13B, the shutter member 50 having an arcuate cross-section is provided at the inner side of the side wall lower portion 6C of the toner cartridge storage section 6. The shutter member 50 is slidable along the inner peripheral surface of the lower storage room 6B (see FIGS. 11A and 11B). The shutter member 50 has a cutout 50A for the engagement with the operating protrusion 49C of FIGS. 12A and 12B and a fitting hole 50B for the fitting engagement with the operating protrusion 49B.

Operation of Toner Feed/Collect Mechanism

When the operating handle 49A is in the engaged position as shown in FIG. 6A, the toner feed opening 49E and the toner collect opening 49F of the inner cylinder 49 as shown in FIG. 9A are respectively in direct communication with the toner feed opening 42C and the toner collect opening 42D of the toner feed unit 42 as shown in FIG. 7. In this engaged position of the operating handle 49A, the shutter member 50 is engaged with the operating protrusions 49B, 49C and has been rotated to a released position as shown in FIG. 13A to thereby release the toner feed opening 6D and the toner collect opening 6E. As a result, the toner feed opening 49E of the inner cylinder 49, the toner feed opening 42C of the toner feed unit 42, and the toner feed opening 6D of the toner cartridge storage section 6 come into direct communication. Also, the toner collect opening 49F of the inner cylinder 49, the toner collect opening 42D of the toner feed unit 42, and the toner collect opening 6E of the toner cartridge storage section 6 come into direct communication.

Therefore, when the operating handle 49A is in the engaged position as shown in FIG. 6A, toner stored in the toner feed unit 42 of the toner cartridge 40 is supplied to the toner feed auger 21 shown in FIG. 5 through the toner feed openings 49E, 42C, and 6D. At the same time, remaining toner carried by the toner collect auger 22 is collected and carried back toward the toner feed unit 42 through the toner collect openings 6E, 42D, and 49F.

Meanwhile, when the operating handle 49A is in the disengaged position as shown in FIG. 6B, the toner feed opening 49E and the toner collect opening 49F of the inner cylinder 49 as shown in FIG. 9A are not in communication with the toner supply opening 42C and the toner collect opening 42D of the toner feed unit 42 as shown in FIG. 7. In this disengaged position of the operating handle 49A, the shutter member 50 has been rotated to a closed position as shown in FIG. 13B to thereby close the toner feed opening 6D and the toner collect opening 6E.

Therefore, when the opening handle 49A is in the disengaged position as shown in FIG. 6B, supply of toner to the toner feed auger 21 (see FIG. 5) is stopped. Also, collection of toner from the toner collect auger 22 is stopped.

Detachable Mechanism for Toner Cartridge

As seen in FIG. 13, as a detachable mechanism for the toner cartridge 40, an engagement groove 6F is formed in the peripheral wall of the lower storage room 6B to which the shutter member 50 is slidably mounted. The engagement groove 6F is engageable with the operating protrusion 49C (see FIGS. 9A and 9B) that is rotatable with the operating handle 49A of the inner cylinder 49.

The engagement groove 6F has an L-shaped configuration consisting of a straight portion which extends in the front and back direction of the inner peripheral wall of the lower storage room 6B, and an arcuate portion which extends from the back end of the straight portion along the inner peripheral surface of the lower storage room 6B. The straight portion of the engagement groove 6F is formed in such a position that when the operating handle 49A is in the disengaged position as shown in FIG. 6B, the operating protrusion 49C corresponds to the straight portion. The cutout 50A of the shutter member 50 also conforms to the straight portion of the engagement groove 6F.

Meanwhile, the arcuate portion of the engagement grove 6F is formed to allow the movement of the operating protrusion 49C when the operating handle 49A is manipulated to rotate from the disengaged position to the engaged position as shown in FIG. 6A.

Therefore, a user inserts the toner cartridge 40 into the toner cartridge storage section 6 from the front side of the laser printer 1 and slides it in the backward direction while the operating handle 49A is in the disengaged position of FIG. 6B. Thereafter, the user manipulates to rotate the operating handle 49A into the engaged position of FIG. 6A. Accordingly, it is possible to readily attach the toner cartridge 40. It is also possible to readily disengage and pull out the toner cartridge 40 from the toner cartridge storage section 6 by the reverse operation.

As described above, according to the laser printer 1 as one embodiment of the image forming apparatus, a paper stored in the paper feed tray 8 is conveyed to the paper output tray 4 through the separation roller 19, the registration roller 20, the photosensitive drum 25 and the transfer roller 27, the heating roller 34 and the pressure roller 35, the conveyance rollers 36, 36, and the paper output rollers 16, 16. During the conveyance of the paper, a toner image is formed on the paper by the process cartridge 11 and the scanner unit 12 which are positioned along the paper conveyance passage, and thereafter the toner image is thermally fixed on the paper by the fixing device 13.

A paper can also be inserted into the main body casing 2 through the manual paper feed unit 39 that is formed at the front side of the laser printer 1 with the lower cover 37 being opened. When the paper is inserted from the lower cover 37, the paper is guided along the guide surface 38A of the paper guide 38 and supplied to the registration roller 20, by which the paper is carried toward the process cartridge 11. After a toner image is formed and fixed on the paper, the paper is discharged and stored in the paper output tray 4.

According to the laser printer 1, because the fixing device 13 is arranged above the process cartridge 11 as the developer unit which comprises the developing roller 24, etc., the process cartridge 11 is not heated by the heat generated and rising from the heating roller 34 of the fixing device 13. The heat rising from the heating roller 34 of the fixing device 13 passes between the paper output rollers 16, 16 and goes through the paper output tray 4 and is smoothly discharged into the air. A heat release opening may be formed in the upper part of the main body casing 2.

Namely, according to the laser printer 1, heat deterioration of toner can be prevented in the process cartridge 11. As a result, a high-quality toner image can be formed on a paper.

Further, in the laser printer 1 as one embodiment of the present invention, the toner cartridge 40 is arranged adjacent to one longitudinal end of the process cartridge 11 which includes the tone feed auger 21, the toner collect auger 22, the feed roller 23, the developing roller 24, etc. This can prevent the size of the laser printer 1 from increasing in the height as well as in the depth (width in the front-back direction).

Providing the toner feed auger 21 for carrying toner in the axial direction thereof enables toner to be carried smoothly from the toner cartridge 40 arranged adjacent to one longitudinal end of the process cartridge 11. Further, because the development chamber 29 is arranged below the developing roller 24, it is possible to reliably prevent toner in the development chamber 29 from leaking into the photosensitive drum 25.

Further, the process cartridge 11, the fixing device 13, and the manual paper feed unit 39 are arranged below the paper output tray 4 by effectively utilizing a dead space. This can advantageously prevent an increase in the depth (width in the front-back direction) of the laser printer 1. Further, because the toner cartridge 40 is separately detachable from the laser printer 1, attachment and detachment of the toner cartridge 40 can be readily performed. Furthermore, because the toner cartridge 40 is pulled out from the front side of the laser printer 1, even if the size of the toner cartridge 40 is large, it is possible to readily pull out the toner cartridge 40 from the laser printer 1.

According to the laser printer 1, the toner feed unit 42 is positioned substantially at the same height as the development chamber 29 in the horizontal direction. Therefore, toner is supplied and collected between the toner feed unit 42 and the development chamber 29 to thereby reliably and smoothly circulate the toner.

Further, the paper output opening 4A is formed at the upper end of the paper output tray 4 so that discharged papers can be stored in the paper output tray 4 with the upper ends thereof protruding from the opening 4A. This is advantageous because the height of the paper output tray 4 is restricted as low as possible, and papers protruding from the paper output opening 4A of the paper output tray 4 can be readily removed by directly pulling them in the upward direction. Therefore, it is possible to improve the operationality of the laser printer 1.

Especially, the upper end of the paper output tray 4 and the upper end of the paper feed tray 8 are substantially at the same height in the vertical direction, so that the paper feed tray 8 is readily pulled out from the main body casing 2 when compared with the configuration in which the paper output tray 4 protrudes upward to a greater extent from the paper feed tray 8.

Papers stored in the paper feed tray 8 may not be conveyed reliably if the papers are bent or wrinkles are formed on the papers due to absorption of moisture. For this reason, in order to prevent papers from being bent, it is preferable that the paper feed tray 8 has a height longer than the height (length in the conveyance direction) of the papers to be stored therein. It is also preferable that the main body casing 2 surrounds all-around surfaces of the papers in order to shut out moisture.

On the contrary, the above drawbacks do not occur in the paper output tray 4. Therefore, it is possible to form the paper output opening 4A at the upper end of the paper output tray 4 so that papers protrude from the paper output opening 4A.

Further, the bottom portion of the paper output tray 4 is positioned lower than the paper discharge opening, so that a sufficient height of the paper output tray 4 is ensured for supporting discharged papers in the tray 4 without protruding the paper output tray 4 upward to a greater extent from the main body casing 2.

According to the laser printer 1, the manual paper feed operation, the attachment and detachment of the process cartridge, the attachment and detachment of the toner cartridge, and the removal of papers from the paper output tray 4 are all performed from the front side of the laser printer 1, thereby leading to improved operationality. Further the paper feed tray 8 can be pulled out upward from the main body casing 2. Therefore, papers can be supplied from above the main body casing 2 as well as from the front side, leading to improved operationality.

Although the present invention has been described in detail with reference to the above preferred embodiment, the present invention is not limited to this specific embodiment and various changes and modifications may be made without departing from the scope of the appended claims.

In the above preferred embodiment, the present invention has been applied to the laser printer 1. However, the present invention may be applicable to other image forming apparatus such as a copying machine and a multifunction device.

In the above preferred embodiment, the developing roller 24 is employed as the developer carrier. However, the present invention is not limited to this specific embodiment and, for example, a belt for carrying toner may be employed.

Further, in the above preferred embodiment, as an example of the developer unit, the process cartridge 11 includes the photosensitive drum 25, etc. in addition to the developing roller 24. However, the present invention is not limited to this specific embodiment. For example, in the case where the cartridge body 28 is separable between the photosensitive drum 25 and the developing roller 24, a unit including the developing roller 24, i.e., a developer cartridge, may be defined as the developer unit.

Figure 14:
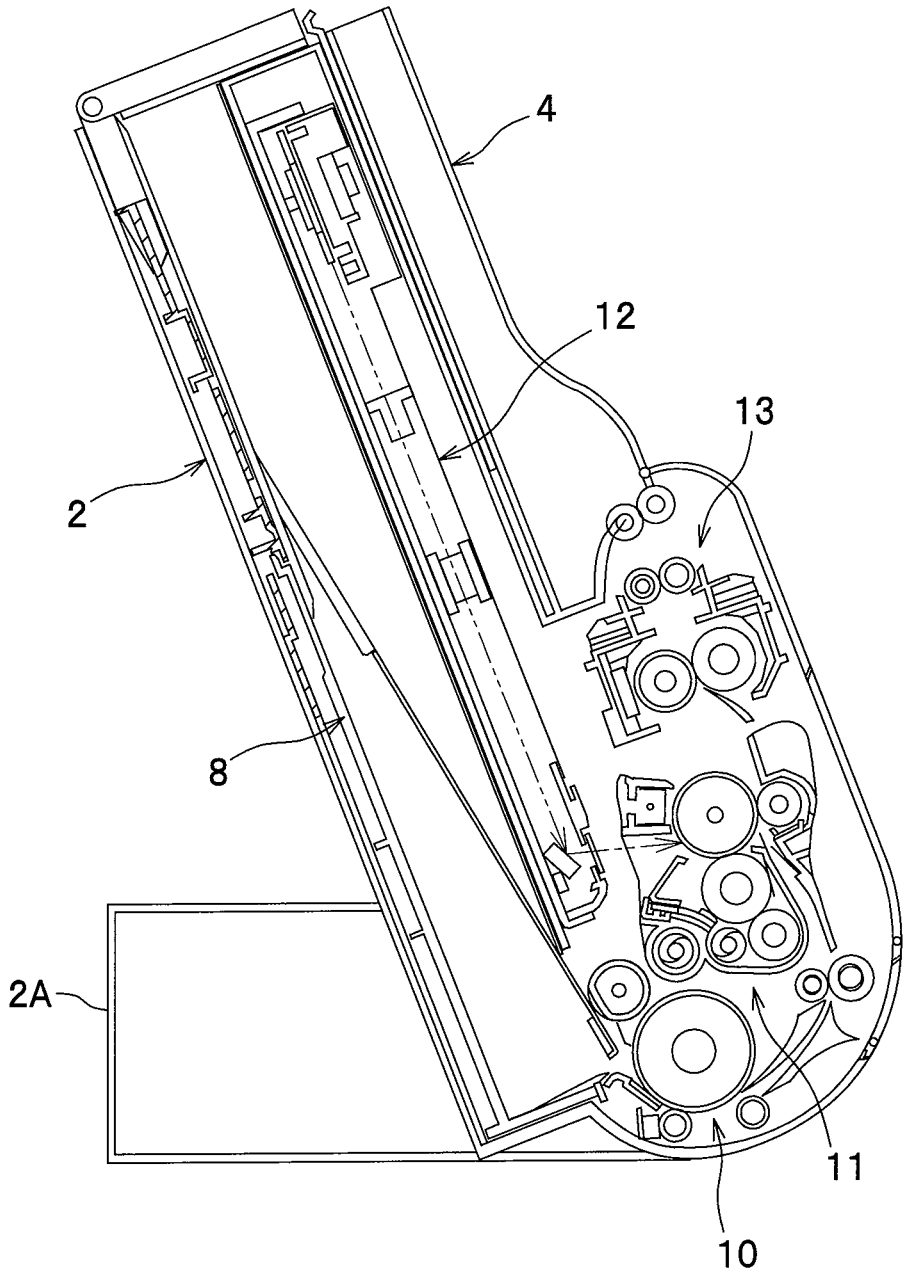
FIG. 14 is a vertical section showing a modification of the laser printer.

According to the above preferred embodiment, the laser printer 1 is configured as an upright-type printer in which the paper output tray 4 is installed in an upright position as shown in FIGS. 3A and 3B. However, the present invention is not limited to this specific embodiment, and the paper output tray 4 may be tilted backward. One example of this configuration is shown in FIG. 14. As seen in FIG. 14, a supporting member 2A is provided at a lower part of the main body casing 2. The supporting member 2A extends backward and supports the paper output tray 4 such that the whole laser printer 1 tilts backward to retain the paper output tray 4 in the backward tilting position.

Further, according to the above preferred embodiment, the toner feed auger 21 is positioned closer to the feed roller 23 and the toner collect auger 22 is positioned remote from the feed roller 23. However, the present invention is not limited to this specific configuration, and they can be arranged reversely.

What is claimed is:

1. An image forming apparatus comprising:

a recording sheet storage unit configured to store recording sheets substantially in an upright position;

an image forming unit configured to form an image on a recording sheet conveyed from the recording sheet storage unit, and including at least a photosensitive drum on which a latent image is to be formed, and a developing roller disposed directly opposite the photosensitive drum, the developing roller configured to supply developer to the photosensitive drum to form a developer image;

a developer receptacle configured to store developer to be supplied to the image forming unit; and a recording sheet receiving unit configured to store the recording sheet conveyed from the image forming unit substantially in an upright position, wherein a sheet conveyance passage for conveying the recording sheet extends upward from a lower portion of the recording sheet storage unit toward the recording sheet receiving unit, wherein the image forming unit is positioned on the sheet conveyance passage and comprises a fixing device and a developer unit including the photosensitive drum and the developer roller, and the fixing device is arranged above the developer unit in a vertical direction when the image forming apparatus is in an operating orientation, and wherein the developing roller is configured to rotate about a rotation axis which extends toward the developer receptacle, and wherein the developer receptacle is configured to be movable relative to the developing roller between a supplying position in which the developer receptacle supplies the developer to the image forming unit and a separate position in which the developer receptacle is separated from the developing roller, and the rotation axis of the developing roller intersects at least a portion of the developer receptacle when the developer receptacle is in the supplying position.

2. An image forming apparatus according to claim 1, wherein a development chamber is arranged below the developing roller, the development chamber being provided for supplying the developing roller with developer stored in the developer receptacle using a developer carrying member, the developer carrying member having a longitudinally-extending rotational shaft and being rotatably supported in the development chamber such that rotation of the developer carrying member causes the developer to be carried along a longitudinal direction of the developer carrying member, and wherein the developer receptacle and the development chamber are provided with a communication hole at a portion facing one another for supplying developer.

3. An image forming apparatus according to claim 1, wherein the developer receptacle is detachable from the image forming apparatus, separately from the image forming unit including the developing roller, through a front opening formed in a front side of the image forming apparatus.

4. An image forming apparatus according to claim 3, wherein the front opening is opened and closed by a front side cover pivotally supported on the front side.

5. An image forming apparatus according to claim 1, wherein a registration roller is provided below the developer unit so that a leading end of the recording sheet conveyed from the recording sheet storage unit is brought into contact with the registration roller and then conveyed upward, and wherein a manual sheet feed unit is provided at a front side where the recording sheet receiving unit is positioned, and through the manual sheet feed unit a recording sheet is manually supplied into the image forming apparatus toward the registration roller.

6. An image forming apparatus according to claim 1, wherein the sheet conveyance passage has a U-shaped configuration as seen from a side, and wherein a vertical distance from the lower portion of the recording sheet storage unit to a bottom portion of the sheet conveyance passage is smaller than a vertical distance from the bottom portion of the sheet conveyance passage to a lower portion of the recording sheet receiving unit.

7. An image forming apparatus according to claim 1, wherein the axis of the developing roller extends between the recording sheet storage unit and the sheet conveyance passage toward the developer receptacle.

8. An image forming apparatus comprising:

a casing;

a recording sheet storage unit provided in the casing and configured to store recording sheets substantially in an upright position;

an image forming unit disposed in the casing and configured to form an image on a recording sheet conveyed from the recording sheet storage unit, the image forming unit including at least a photosensitive drum on which a latent image is to be formed, and a developing roller disposed directly opposite the photosensitive drum, the developing roller configured to supply developer to the photosensitive drum to form a developer image;

a developer receptacle disposed in the casing and configured to store developer to be supplied to the image forming unit; and a recording sheet receiving unit provided in the casing and configured to store the recording sheet conveyed from the image forming unit substantially in an upright position, wherein a sheet conveyance passage for conveying the recording sheet extends upward from a lower portion of the recording sheet storage unit toward the recording sheet receiving unit, wherein the image forming unit is positioned on the sheet conveyance passage and comprises a fixing device and a developer unit including the photosensitive drum and the developing roller, and the fixing device is arranged above the developer unit in a vertical direction when the image forming apparatus is in an operating orientation, wherein the developer unit includes a first cartridge configured to form the developer receptacle and to be detachably mounted to the casing separately from the developing roller, and wherein the developing roller is configured to rotate about a rotation axis which extends toward the developer receptacle, and wherein the developer receptacle is configured to be movable relative to the developing roller between a supplying position in which the developer receptacle supplies the developer to the image forming unit and a separate position in which the developer receptacle is separated from the developing roller, and the rotation axis of the developing roller intersects at least a portion of the developer receptacle when the developer receptacle is in the supplying position.

9. An image forming apparatus according to claim 8, wherein the developer unit includes a second cartridge configured to store the developing roller and the photosensitive drum and to be detachably mounted to the casing.

10. An image forming apparatus according to claim 8, wherein the developer receptacle has a vertical dimension and a horizontal dimension when it is in the supplying position, and the vertical dimension is larger than the horizontal dimension.

11. An image forming apparatus according to claim 10, wherein the developer receptacle extends upward beyond an uppermost portion of the photosensitive drum.

12. An image forming apparatus according to claim 8, wherein the developer receptacle is detachable from the image forming apparatus, separately from the image forming unit, through a front opening formed in a front side of the image forming apparatus.

13. An image forming apparatus according to claim 12, wherein the front opening is opened and closed by a front side cover pivotally supported on the front side.

14. An image forming apparatus according to claim 8, wherein the axis of the developing roller extends between the recording sheet storage unit and the sheet conveyance passage toward the developer receptacle.

15. An image forming apparatus according to claim 8, wherein, when viewed from an axial direction of the photosensitive drum, the developer receptacle overlaps the fixing device when the developer receptacle is in the supplying position.

* * * * *